US006029974A

United States Patent [19]

Povitz

[11] Patent Number: 6,029,974

[45] Date of Patent: Feb. 29, 2000

[54] BLOCK PUZZLES ASSEMBLY

[76] Inventor: Cary Povitz, 245 Bates Road, Mount-Royal (Town) QC, Canada, H3S 1A1

[21] Appl. No.: 09/186,650

[22] Filed: Nov. 6, 1998

[51] Int. Cl.[7] ..... A63F 9/08

[52] U.S. Cl. ..... 273/157 R; 273/156

[58] Field of Search ..... 273/157 R, 153 R, 273/156; 446/117, 125, 118, 120, 124

[56] References Cited

U.S. PATENT DOCUMENTS

| | | | |
|---|---|---|---|
| 1,636,371 | 7/1927 | Kenney | 273/157 R |
| 2,041,030 | 5/1936 | Strutton . | |
| 3,302,311 | 2/1967 | Israel | 273/157 R |
| 3,873,096 | 3/1975 | Shoptaugh | 273/157 R |
| 3,993,313 | 11/1976 | Tillotson | 273/157 R |
| 4,308,016 | 12/1981 | White | 273/157 R |
| 4,744,780 | 5/1988 | Volpe | 446/128 |
| 5,785,319 | 7/1998 | Frauhiger | 273/157 R |

*Primary Examiner*—Steven Wong

[57] ABSTRACT

The present invention relates to a new block puzzles assembly that is comprised of four stacks of a plurality of similar, generally rectangular shaped blocks with circular tenon male attachment part on their closed top face and complementary female attachment part enclosed within their open bottom face, allowing blocks to be releasably held together when assembled in vertical stacks. Each of a pair of side faces of a block have a portion of a first image, each of the other pair of side faces of the same block have a portion of a second image. A first image being produced on a vertical plane when stacks are properly arranged in a generally rectangular shaped stack assembly. A second image being produced when all stacks of same properly arranged stack assembly are turned around their vertical axis.

8 Claims, 2 Drawing Sheets

BLOCK PUZZLES ASSEMBLY

FIELD OF THE INVENTION

The present invention relates to an entertainment device for children and more particularly to a block puzzles assembly.

BACKGROUND OF THE INVENTION

Patents for block puzzles producing images when properly assembled have been granted. U.S. Pat. No. 2,041,030 discloses a puzzle comprised of a plurality of different types of blocks that are constructed to fill the space of a container and to produce a puzzle image when assembled. This prior art device provides for blocks to be properly assembled on a horizontal plane in order to produce a given single image, such blocks are not attached and can easily fall out of their container if the container is shaken or moved. Furthermore, the prior art block puzzles do not provide for second images to be produced when turning the assembled blocks.

OBJECTS OF THE INVENTION

It is an object of the present invention to provide a plurality of generally same shaped puzzle blocks that obviate the above mentioned disadvantages.

Another object of the present invention to provide puzzle blocks that can be easily and releasably stacked on top of each other and relatively tightly held together via attachment means.

A further object of the present invention to provide puzzle blocks that when properly arranged in a stack assembly produce a first image along a vertical plane.

Still another object of the present invention to provide a stack assembly that when properly arranged produces a second image when the stacks of puzzle blocks of the stack assembly are turned 180° around their vertical axis.

Still a further object of the present invention to provide a block puzzles assembly that is easy to use and accessible to children of a very young age.

SUMMARY OF THE INVENTION

The present invention consists of a block puzzles assembly that comprises four stacks of a plurality of blocks, each block with four side faces, each side face parallel to another side face, a top and a bottom face and matching male and female attachment means, protruding from top face and enclosed within bottom face respectively, for attaching blocks in a stack on a support surface, with each side face coplanar and forming a set of side faces, and with a bottom face of a superposed block contiguous with the top face of an underlying block in any of a plurality of assembled positions of blocks. Each stack having four sets of side faces and arranged side by side with one exposed pair and one concealed pair of sets of side faces, each set of an exposed pair of a stack being coplanar with one set of an exposed pair of a different stack so as to form an assembly of stacks. Each side face bearing a complementary portion of an image. The image being properly completed in only a first assembled position of blocks and in a first and second arrangement of assembly of stacks.

Preferably, all blocks have a similar thickness between their respective parallel side faces and a similar height between their respective bottom and top face.

Preferably the block puzzles further comprises top and bottom plate blocks, having a width which is a multiple of the width of the blocks. The width of any given block being between its parallel side faces. The top and bottom plate blocks bridging assembly of stacks with the male attachment means of bottom plate block inserted into the female attachment means of the next superposed blocks of the assembly of stacks and with the female attachment means of the top plate block receiving the male attachment means of the next underlying blocks of the assembly of stacks.

Preferably, the male attachment means are circular tenons.

Preferably, with the block puzzles a first image is produced by the first arrangement of assembly of stacks and a second image is produced by the second arrangement of assembly of stacks.

Preferably, the second arrangement of assembly of stacks is provided by each stack of an assembly is positioned such that the concealed pair of sets of side faces are revealed and the exposed pair of sets of side faces are concealed.

BRIEF DESCRIPTION OF THE DRAWINGS

In the annexed drawings, like reference characters indicate like elements throughout.

DETAILED DESCRIPTION OF THE PREFERRED EMBODIMENT

With reference to the associated drawings the preferred embodiment of the present invention will be herein described for indicative purpose and by no means as of limitation.

Figure 1:
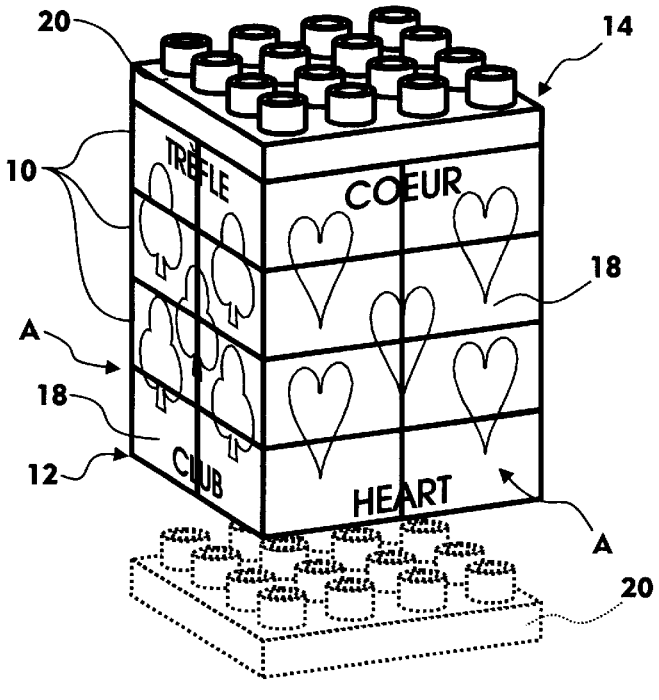
FIG. 1 is a perspective view of the preferred embodiment of the present invention having been properly arranged and producing a first puzzle image.
Figure 2:
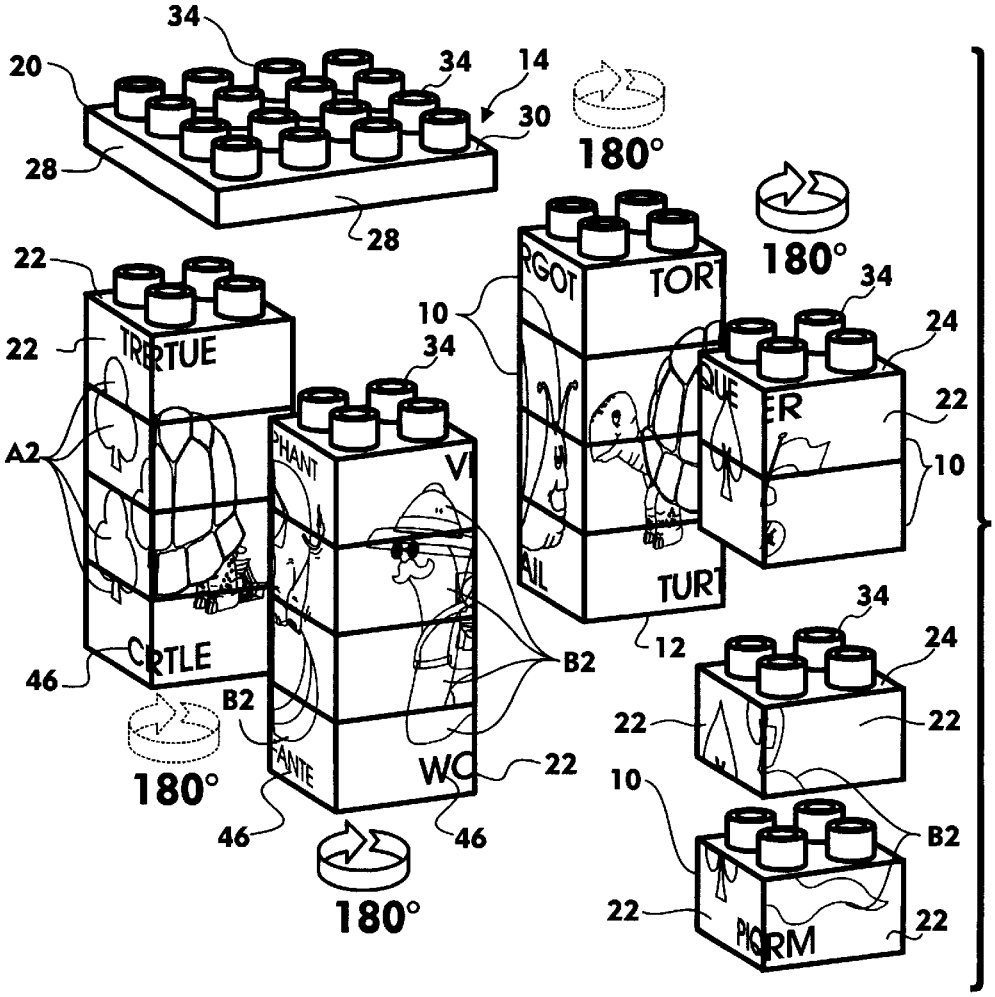
FIG. 2 is a perspective view of the preferred embodiment in a disassembled position.

FIG. 1 shows puzzle blocks 10 properly assembled in vertical columns or stacks 12 , shown more clearly in FIG. 2, which in turn are properly arranged in a generally rectangular shaped stack assembly 14. The foregoing assembly of blocks 10 and arrangement of stacks 12 provide for a given puzzle an image A to be produced along a vertical plane on each side 18 (only two sides shown here) of stack assembly 14. An image preferably refers to a drawing, a picture, colors, numbers, letters or any combination thereof. As shown, stacks 12 of a stack assembly 14 are preferably bridged together by top or bottom plate blocks 20, the latter illustrated here in dotted lines, providing the present invention with a sufficient degree of stability by keeping stacks 12 in position. Blocks 10 and 20 are preferably made out of a plastic material, preferably of the same color.

FIG. 2 shows stack assembly 14 in a disassembled position. Each puzzle block 10 has a generally rectangular shape with four side faces 22, a closed top face 24 and an open bottom face 26 (see FIG. 3). Each side face 22 of a block 10 is parallel to another side face 22 of the same block 10. All of blocks 10 have a similar thickness between their respective parallel side faces 22 and a similar height between their bottom face 26 and top face 24. Plate blocks 20 have four side faces 28, a top face 30 and a bottom face 32 (shown in FIG. 3). Furthermore, plate blocks 20 have a width and length which is a multiple of the width and length of blocks 10, preferably of two, the width and length of any given block 10 and 20 being between its respective parallel side faces 22 and 28 respectively, so as to cover the top faces 24 of the next underlying four blocks 10 or to cover the bottom faces 16 of the next superposed four blocks 10 of a stack assembly 14 as shown in FIG. 1.

Protruding from the top faces 24 and 30 of blocks 10 and 20 are male attachment means, preferably circular tenons 34. Each block 10 has four circular tenons 34 protruding from its top closed face 24, while each plate block 20 has sixteen circular tenons 34 protruding from its top face 30.

Figure 3:
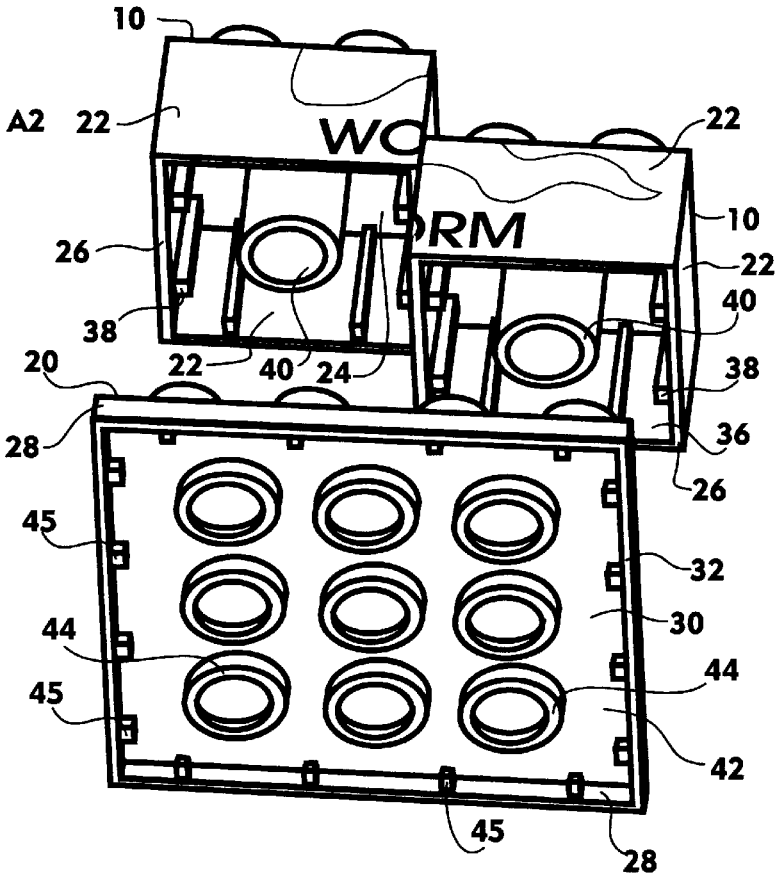
FIG. 3 is a perspective back view of same block puzzles assembly of the preferred embodiment.

FIG. 3 reveals the complementary female attachment means 36 enclosed within bottom face 26 of puzzle blocks 10. Female attachment means 26 are defined by a set of short, vertical ridges 38 inwardly projecting along and from side faces 22 and by one circular tenon 40 downwardly protruding from top face 24 extending down to near the open extremity of bottom face 26 of block 10. The female attachment means 42 of each plate block 20 is provided by nine circular tenons 44 downwardly protruding from top face 30 extending down to near the extremity of open bottom face 32 and by a set of short vertical ridges 45 inwardly projecting along and from side faces 28.

When two of any blocks 10, 20 are assembled together via the attachment means, the vertical ridges 45, 38 and circular tenons 44, 40 of female attachment means 42 and 36 of a top plate block 20 and of any upper block 10 respectively, releasably receive, in a tenon mortise type mutual interference fit, the circular tenons 34 of the male attachment means of a bottom plate block 20 or any given lower block 10 which engage therein.

Each block 10 has a complementary portion A2 of a first image A (see FIG. 1) on two non-parallel side faces 22 and a complementary portion B2 of a second image B (see FIG. 2) on the two other non-parallel side faces 22. When blocks 10 are properly assembled in a stack 12 their side faces 22 bearing complementary portions of the same image are coplanar and form a set 46 of side faces. Each stack 12 has four sets 46 of coplanar side faces 22. A puzzle image A is properly completed when each of the four stacks 12 is arranged side by side with an exposed pair of sets 46 and a concealed pair of sets 46. Each set 46 of an exposed pair of a given stack 12 (hereinafter referred to as a "first set" for convenience purpose only) is coplanar to only one complementary set 46 of another stack 12 (hereinafter referred to as a "second set" for convenience purpose only) so as to form a generally rectangular shaped stack assembly 14 with four sides 18 as shown in FIG. 1. Each complementary "first" and "second" sets 46 have coplanar side faces bearing complementary portions of the same puzzle image hence, completing image A on each side 18 of the rectangular shaped stack assembly 14.

Figure 4:
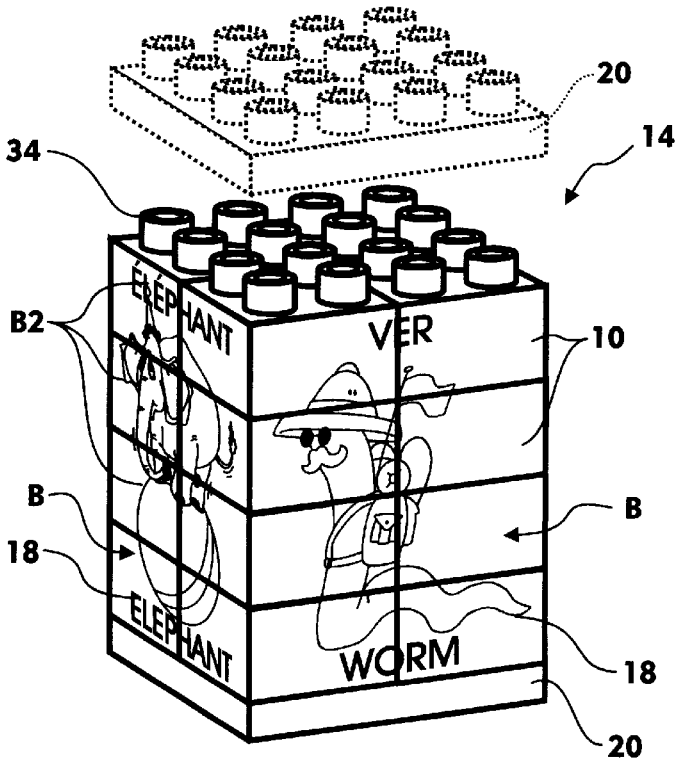
FIG. 4 is a perspective view of the preferred embodiment similar to FIG. 1 producing a second puzzle image.

When an image A has been completed with the stack assembly 14 being arranged in the foregoing manner a second puzzle image B may be produced, as shown in FIG. 4, on each side 18 of the stack assembly 14 (only two sides shown here) by simply turning each stack 12 180° around its vertical axis, as shown in FIG. 2, so as to reveal the concealed pair of sets 46 and to conceal the exposed pair of sets 46. Each newly revealed "first" set 46 will be coplanar to only one newly revealed complementary "second" set 46 of another stack 12. The newly revealed complementary first and second sets 46 have coplanar side faces 22 bearing complementary portions of the same image hence, completing image B on each side 18 of the rectangular shaped stack assembly 14.

Hence, when properly stacking blocks 10 the image portions A2 and B2 of a given stack 12 are simultaneously properly sequenced.

The present invention is not limited to the features of the embodiment described and illustrated herein, but includes all variations and modifications within the scope of the claims.

I claim:

1. A block puzzle comprising four stacks of a plurality of blocks, each of said block with four side faces, each said side face parallel to another said side face, a top and a bottom face and matching male and female attachment means, protruding from said top face and enclosed within said bottom face respectively, for attaching said blocks in a said stack on a support surface, with each of said side faces coplanar and forming a set of side faces, and with a bottom face of a superposed block contiguous with the top face of an underlying block in any of a plurality of assembled positions of said blocks, each of said stack having four said sets of side faces and arranged side by side with one exposed pair and one concealed pair of said sets of side faces, each set of a said exposed pair of a stack being coplanar with one set of a said exposed pair of a different stack so as to form an assembly of stacks, each of said side faces bearing a complementary portion of an image, said image being properly completed in only a first said assembled position of said blocks and in a first and second arrangement of said assembly of stacks.

2. A block puzzles as defined in claim 1, wherein all said blocks have a similar thickness between their respective parallel side faces and a similar height between their respective said bottom and top face.

3. A block puzzles as defined in claim 2 further comprising top and bottom plate blocks, having a width which is a multiple of the width of said blocks, the width of any given block being between its parallel said side faces, said top and bottom plate blocks bridging said assembly of stacks with the male attachment means of said bottom block inserted into the female attachment means of the next superposed blocks of said assembly of stacks and with the female attachment means of said top plate block receiving the male attachment means of the next underlying blocks of said assembly of stacks.

4. A block puzzles as defined in claim 3, wherein said male attachment means are circular tenons.

5. A block puzzles as defined in claim 1 wherein a first image is produced by said first arrangement of assembly of stacks and a second image is produced by said second arrangement of assembly of stacks.

6. A block puzzles as defined in claim 3 wherein a first image is produced by said first arrangement of assembly of stacks and a second image is produced by said second arrangement of assembly of stacks.

7. A block puzzles as defined in claim 5 wherein said second arrangement of assembly of stacks is provided by each said stack of a said assembly being positioned such that said concealed pair of sets of side faces are revealed and said exposed pair of sets of side faces are concealed.

8. A block puzzles as defined in claim 6 wherein said second arrangement of assembly of stacks is provided by each said stack of a said assembly being positioned such that said concealed pair of sets of side faces are revealed and said exposed pair of sets of side faces are concealed.

* * * * *